US010260823B2

(12) United States Patent
Cooney

(10) Patent No.: US 10,260,823 B2
(45) Date of Patent: Apr. 16, 2019

(54) FREEZE PROTECTION SYSTEM WITH DRAINAGE CONTROL FOR HEAT TRANSFER COILS IN HVAC SYSTEMS

(71) Applicant: Robert Cooney, Phoenixville, PA (US)

(72) Inventor: Robert Cooney, Phoenixville, PA (US)

( * ) Notice: Subject to any disclaimer, the term of this patent is extended or adjusted under 35 U.S.C. 154(b) by 0 days.

(21) Appl. No.: 15/341,697

(22) Filed: Nov. 2, 2016

(65) Prior Publication Data

US 2017/0074606 A1 Mar. 16, 2017

Related U.S. Application Data

(63) Continuation-in-part of application No. 14/613,448, filed on Feb. 4, 2015, now Pat. No. 9,541,338, which is a continuation of application No. 14/071,022, filed on Nov. 4, 2013, now Pat. No. 9,448,018.

(60) Provisional application No. 61/727,799, filed on Nov. 19, 2012.

(51) Int. Cl.

| | |
|---|---|
| ***F28F 27/00*** | (2006.01) |
| ***F28F 9/02*** | (2006.01) |
| ***F28D 1/047*** | (2006.01) |
| *F24F 140/30* | (2018.01) |

(52) U.S. Cl.

CPC ..... *F28F 27/00* (2013.01); *F28D 1/0477* (2013.01); *F28F 9/0231* (2013.01); *F24F 2140/30* (2018.01); *F28F 2265/14* (2013.01)

(58) Field of Classification Search

CPC ..... F28F 27/00; F28F 17/00; Y10T 137/1189; F24D 19/0095

See application file for complete search history.

(56) References Cited

U.S. PATENT DOCUMENTS

| | | | |
|---|---|---|---|
| 443,873 | A | 12/1890 | Snow |
| 1,018,354 | A | 2/1912 | Fairfield |
| 1,125,063 | A | 1/1915 | Colberg |
| 1,159,225 | A | 11/1915 | Howell |
| 1,274,988 | A | 8/1918 | Chadwick |
| 1,554,344 | A | 9/1925 | Haapanen |
| 1,573,157 | A | 2/1926 | Giddings, Jr. |
| 1,900,836 | A | 3/1933 | Merritt |
| 2,012,361 | A | 8/1935 | Thomas |

(Continued)

FOREIGN PATENT DOCUMENTS

| | | |
|---|---|---|
| AU | 7282681 | 7/1981 |
| CH | 169433 | 5/1934 |

(Continued)

*Primary Examiner* — Eric S Ruppert

(74) *Attorney, Agent, or Firm* — Drinker Biddle & Reath LLP

(57) ABSTRACT

A pressure and/or temperature relief header for use in an HVAC heat transfer coil includes a main body adapted to be secured to bends in fluid coils of the HVAC fluid tube system. The main body includes holes in alignment with holes formed in the bends to enable liquid to pass from the bends into the expansion relief header. The expansion relief headers include a pressure release valve that automatically opens, preferably in response to pressure exceeding a predetermined threshold value or temperature falling below a predetermined value, to release liquid from the expansion relief header and then reseats. A discharge housing collects liquid released through the pressure release valve. A sensor detects the presence of liquid in the discharge housing.

13 Claims, 4 Drawing Sheets

(56) References Cited

U.S. PATENT DOCUMENTS

| | | | | |
|---|---|---|---|---|
| 2,269,895 | A | | 1/1942 | Foster |
| 2,526,794 | A | | 10/1950 | Andrews |
| 2,580,426 | A | | 1/1952 | Heigis |
| 2,915,216 | A | | 12/1959 | Coffman |
| 2,975,983 | A | | 3/1961 | Niebling |
| 3,080,091 | A | | 3/1963 | Philip |
| 3,090,433 | A | | 5/1963 | Amorosi et al. |
| 3,319,657 | A | | 5/1967 | Nyiri |
| 3,844,310 | A | | 10/1974 | Brindisi |
| 4,047,561 | A | | 9/1977 | Jaster et al. |
| 4,146,047 | A | | 3/1979 | Wood et al. |
| 4,269,214 | A | | 5/1981 | Forsythe et al. |
| 4,316,624 | A | | 2/1982 | Davlin |
| 4,458,138 | A | | 7/1984 | Adrian et al. |
| 4,549,565 | A | | 10/1985 | Short, III |
| 4,770,446 | A | | 9/1988 | Keller |
| 4,928,754 | A | | 5/1990 | Westerberg |
| 5,014,731 | A | * | 5/1991 | Westerberg ..... A62C 3/004 137/512 |
| 5,074,282 | A | * | 12/1991 | Reed ..... F24J 2/26 126/588 |
| 5,213,378 | A | | 5/1993 | MacGregor |
| 5,558,158 | A | | 9/1996 | Elmore |
| 5,579,828 | A | | 12/1996 | Reed |
| 5,697,546 | A | | 12/1997 | Cicioni |
| 6,119,729 | A | | 9/2000 | Oberholzer |
| 6,173,767 | B1 | | 1/2001 | Kennon |
| 6,213,200 | B1 | | 4/2001 | Carter et al. |
| 2003/0024692 | A1 | | 2/2003 | Wu |
| 2010/0170210 | A1 | | 7/2010 | McClanahan et al. |
| 2010/0290190 | A1 | | 11/2010 | Chester et al. |

FOREIGN PATENT DOCUMENTS

| | | | | |
|---|---|---|---|---|
| CN | 201589401 | | * | 9/2010 |
| DE | 102005030633 | A1 | | 1/2007 |
| EP | 0454559 | A1 | | 10/1991 |
| EP | 1215462 | A2 | | 6/2002 |
| EP | 1528346 | A2 | | 5/2005 |
| FR | 2562982 | | * | 10/1985 |
| GB | 297270 | | | 9/1928 |
| JP | 59112138 | | * | 6/1984 |
| JP | 0498021 | | * | 3/1992 |
| JP | 1038303 | | * | 2/1998 |
| WO | 2009046565 | A1 | | 4/2009 |

* cited by examiner

FREEZE PROTECTION SYSTEM WITH DRAINAGE CONTROL FOR HEAT TRANSFER COILS IN HVAC SYSTEMS

RELATED APPLICATION

The present application is a continuation-in-part of U.S. application Ser. No. 14/613,448, filed Feb. 4, 2015, which is a continuation of U.S. application Ser. No. 14/071,022 filed Nov. 4, 2013 and granted on Sep. 20, 2016 as U.S. Pat. No. 9,448,018, which claimed priority from U.S. Provisional Patent Application Ser. No. 61/727,799 filed Nov. 19, 2012, the disclosures of which are incorporated herein by reference in their entirety.

FIELD OF THE INVENTION

The present invention is directed to devices for use on heating, ventilating and air conditioning (HVAC) systems that reduce the risk of fluid tubes in the HVAC system from splitting when the fluid expands. In particular invention is directed to devices that allow for fluid expansion, and possibly fluid removal with the use of temperature and/or pressure relief devices.

BACKGROUND OF THE INVENTION

Fluid tubes are commonly used in HVAC systems, primarily in air handlers and similar cooling or heating systems. These systems are commonly used with cool or hot water, but could also be used to condense steam into a liquid in a beating system. Typically, these HVAC systems have a heat transfer medium, in the form of fluid. As used herein the term "fluid" covers both liquid, and steam. The fluid circulates throughout tubes to acquire or lose heat, usually from or to an air flow. The end of one rube is connected to the beginning of a next tube by a "return bend," typically semicircular so that the next tube runs side-by-side with the one tube, crossing the air flow in the opposite direction. The common industry term for these HVAC heat transfer components is "coils." The tubes in the coils are subject to damage when the fluid in the tubes is exposed to wide temperature differences, and as a result, is subject to changes in state. In the case of water, for instance, it will change from a liquid to a solid (ice) at low temperatures. At temperatures at or below 32° F. (0° C.), the water in the tubes is subject to freezing and the expansion of the water may result in splitting of the tubes.

Historically, ice masses form inside the tubes and expand outward creating excessive pressure in the tubes and at the return bends. The effect of freezing may cause the tubes to expand and split. Upon thawing, the water is released through the damaged tubes or return bends, thus flooding the air handler, an area around the air handler on the level the air handler resides, and any levels below. This may create a series of expensive repairs, not only to the coil and the frozen equipment but now to all building components that are around and below the area of the flooding. In addition, costly shut down time of offices, manufacturing spaces, labs and other building areas can result. This shut down time of operations of any facility requires emergency measures with possible excessive costs depending on the sensitivity of the operations involved.

Past tube or return bend damage prevention has taken the form of bladders, freeze plugs and various other devices. The use of these devices presents many problems to the maintainers of these systems. First and foremost, these devices, once they are activated, require labor to repair or replace. Furthermore, freeze plugs or rupture caps are designed to blow out in the event of excessive pressure caused by freezing, which results in flooding after the blow out of the plugs upon thawing of the ice.

SUMMARY OF THE INVENTION

An embodiment of a device is designed for the condition where water (or other fluid medium) in tubes of an HVAC system changes From a liquid state (water) to a solid state (ice). The device includes piping expansion relief headers arranged to connect to bends in the tubes and to allow the water to enter the expansion relief header and to permit pressure to build within the expansion relief header as the water in the tubes expands during freezing in order to prevent damaging (e.g., splitting) of the tubes. The piping expansion relief headers include pressure relief valves, to enable water to be automatically released from the expansion relief header when the pressure within the expansion relief header exceeds a predetermined value, and optionally also when the temperature of the fluid is below a predetermined value, so as to prevent damage to the tubes and return bends. The released liquid is collected in a discharge housing, and the presence of liquid in the discharge housing is detected by a sensor. The expansion relief headers with the relief valves are configured to work repeatedly over many periods of freezing and thawing and also over many periods of changes in pressure with minimum human intervention and minimum need for maintenance. The use of the expansion relief headers with the relief valves enables an HVAC system to be "freeze safe" or "change of state safe." The output from the sensor can be used to alert personnel to a freeze state, and/or to control the operation of the HVAC system to reduce the risk of further freezing.

It is to be understood that both the foregoing general description and the following detailed description are exemplary and explanatory and are intended to provide further explanation of the invention as claimed.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DESCRIPTION OF THE INVENTION

FIGS. 1-4 illustrate various views of an example embodiment of an expansion relief system utilized on an HVAC heat transfer coil of an air handler 42 in or on a building 50 (see FIG. 4), The use of the expansion relief header provides an HVAC system that is "freeze safe." The expansion relief header enables fluid to flow out of the tubes and into an additional volume or area to accommodate fluid expansion caused by a change in fluid state (e.g., water turning to ice). The expansion relief header may also provide additional pressure relief from expansion and/or phase change of the fluid used in the tubes. The expansion relief header not only relieves pressure to protect the return bends of the fluid tubes but also allows for the resealing after expansion.

Figure 1:
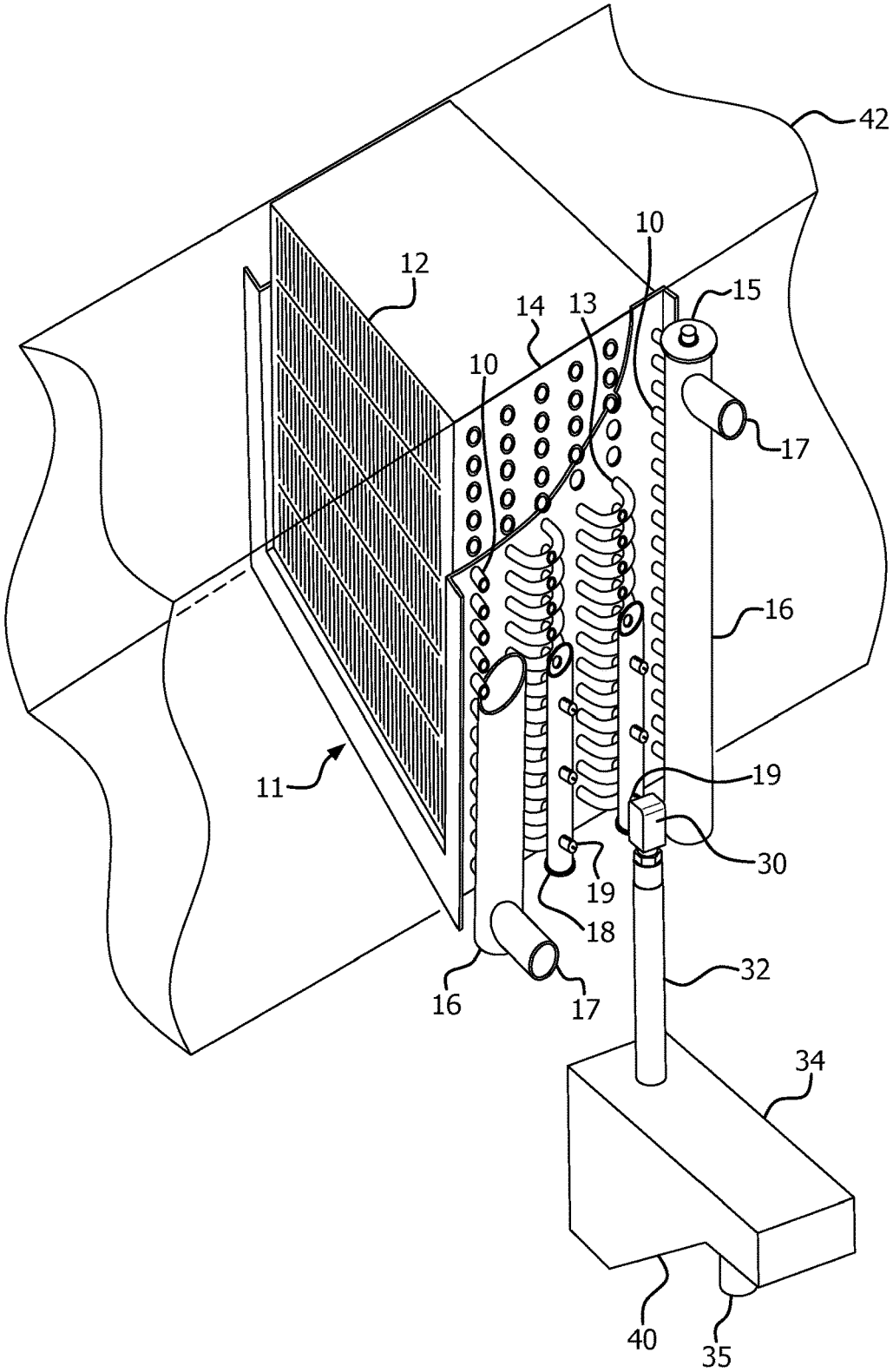
FIG. 1 is a general perspective representation of an air handler with a coil assembly including an expansion relief system according to an embodiment of the present invention.
Figure 4:
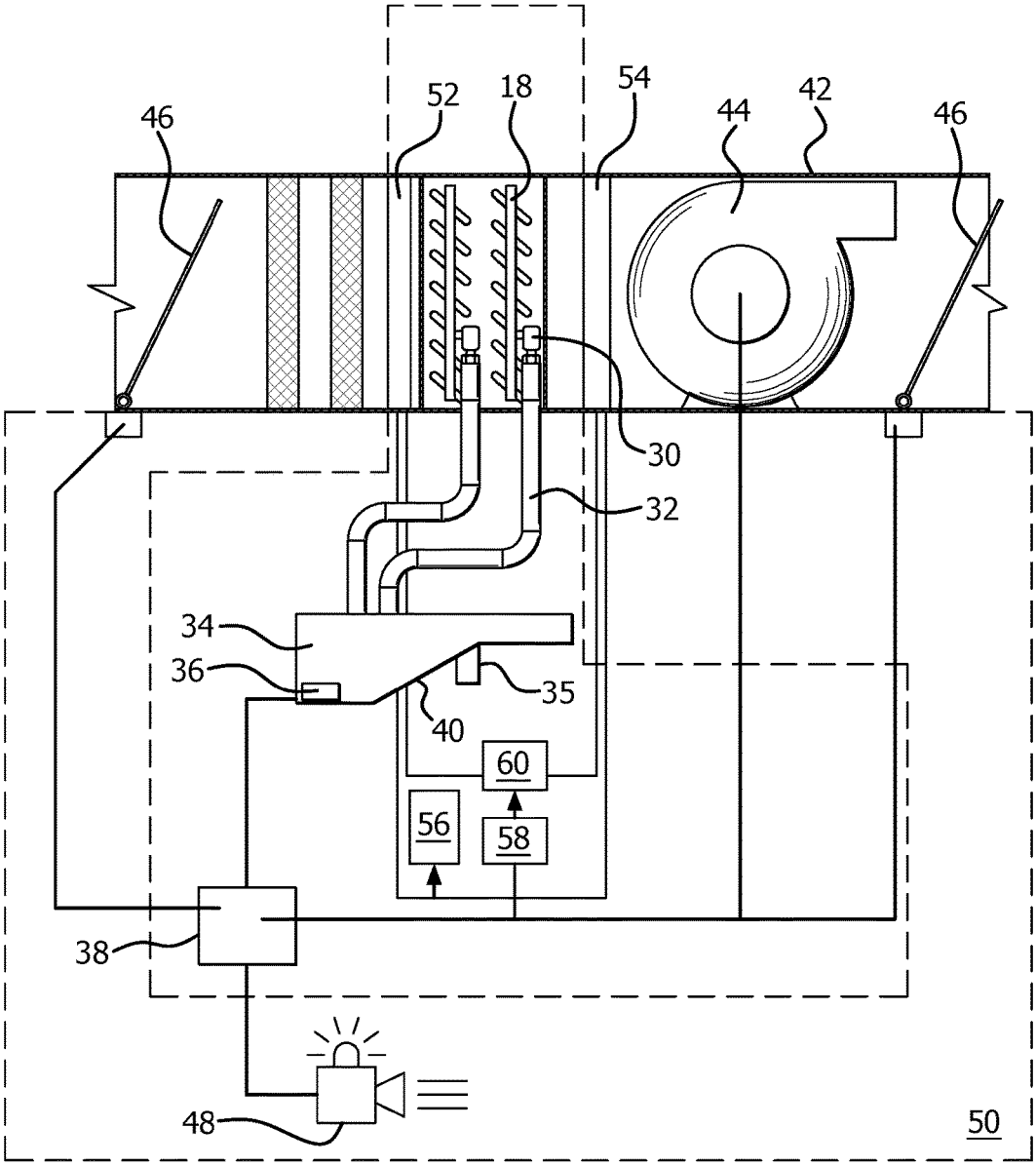
FIG. 4 is a side view of an air handler including the relief system of FIG. 1.

FIG. 1 illustrates a perspective view of an example expansion relief header utilized on an HVAC heat transfer coil of an air handler 42 in or on a building 50 (see FIG. 4). As illustrated, various elements of the air handler HVAC heat transfer coil are "cut away" to make it clear to the observer the basic ideas of this "change of state safe" system. The HVAC heat transfer coil includes a system casing 11 that has fins 12 formed therein for heat transfer. The casing 11 also has holes 14 running through the casing that secure fluid tubes 10. Fluid tube return bends 13 are utilized to connect fluid tubes 10. Piping 17 is utilized to supply/return fluid to main headers 16 that feed the fluid tubes 10 (e.g. supply on right side and return on left side). The main headers 16 include vent connections 15 for air removal and/or draining.

The expansion relief headers 18 are configured to align with and connect to the bends 13. The expansion relief headers 18 may include holes, connectors or the like (not separately numbered) in alignment with the bends 13. The bends 13 may have holes (not separately numbered) formed therein. The holes in the expansion relief headers 18 are then connected to the holes in the bends 13 so as to allow fluid to expand from the tubes 10 into the expansion relief headers 18 if and when necessary. The expansion relief headers 18 may also include vent connections 15 for air removal and/or draining (not separately numbered). The expansion relief headers 18 may include holes or connectors (not separately numbered) for receiving relief devices 19. The relief devices 19 may be on opposite side of the holes in alignment with the bends 13. The relief devices 19 may open to allow fluid to escape from the expansion relief headers 18 if additional fluid expansion is necessary. The relief devices 19 may include temperature and/or pressure relief devices designed to open at set values (e.g., temperature, pressure) so that a portion of the liquid will be dispersed and the tubes 10 are "change of state safe". The number of relief devices 19 utilized may vary depending on various parameters, including the size, shape and type of unit and the anticipated environmental (e.g., weather) conditions. The relief devices 19 may automatically reseal after opening for fluid expansion (once the pressure and/or temperature returns to a certain value). In an alternative embodiment, the relief devices 19 may not automatically reseal after being opened for fluid expansion. These types of relief devices may need to be replaced and/or reset after opening or risk leakage of fluid therefrom even when fluid expansion is not required.

Figure 2:
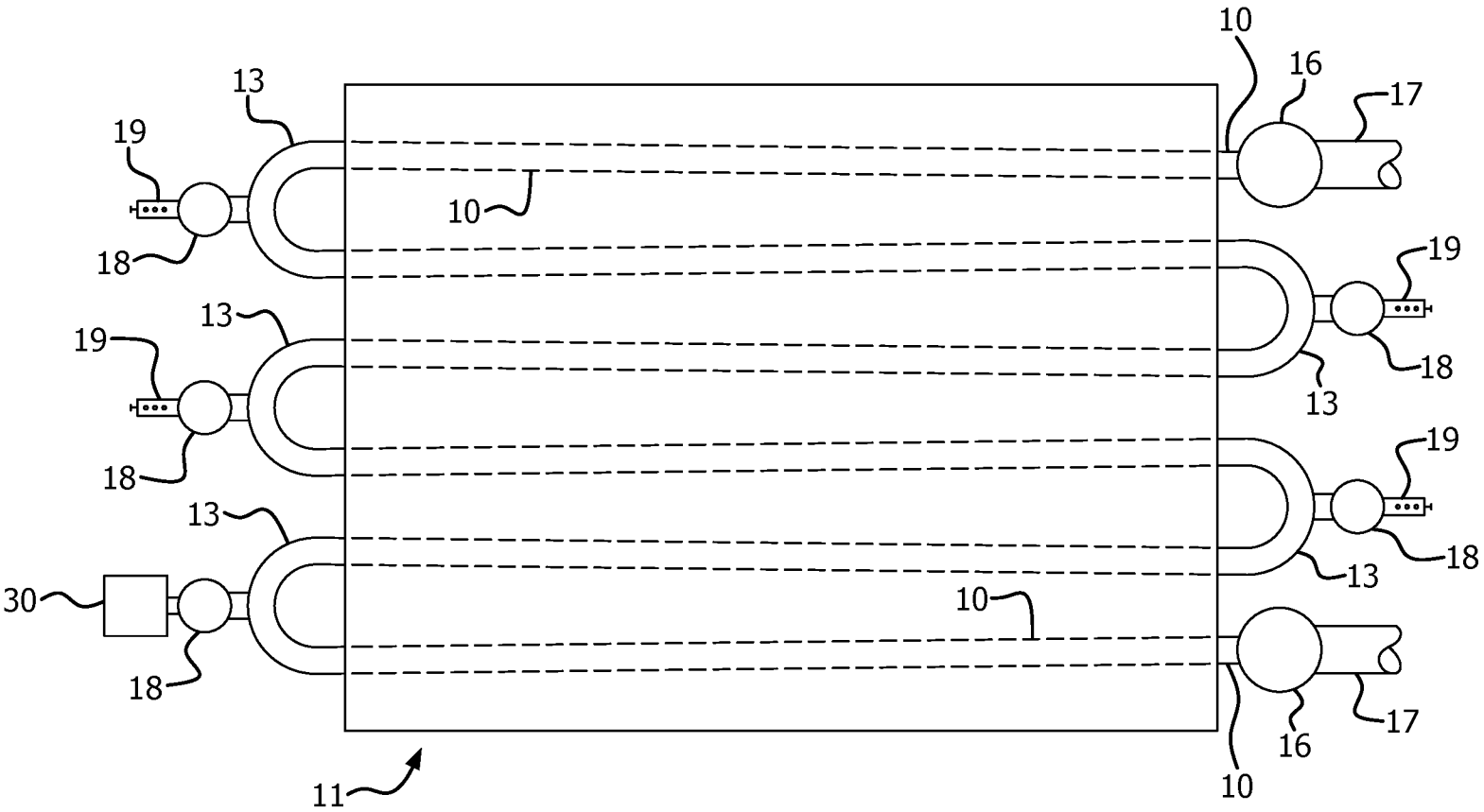
FIG. 2 is a top view of an expansion relief header in the coil assembly of FIG. 1.

FIG. 2 illustrates a top view of an example expansion relief header utilized on an HVAC tube system. The tubes 10 run through the system and the bends 13 connect adjacent tubes 10. The piping 17 is utilized to supply/return fluid to main headers 16 that feed a single column of fluid tubes 10 on each side of the device. The expansion relief headers 18 are connected to the bends 13 and may have one or more relief devices 19 connected thereto.

Figure 3:
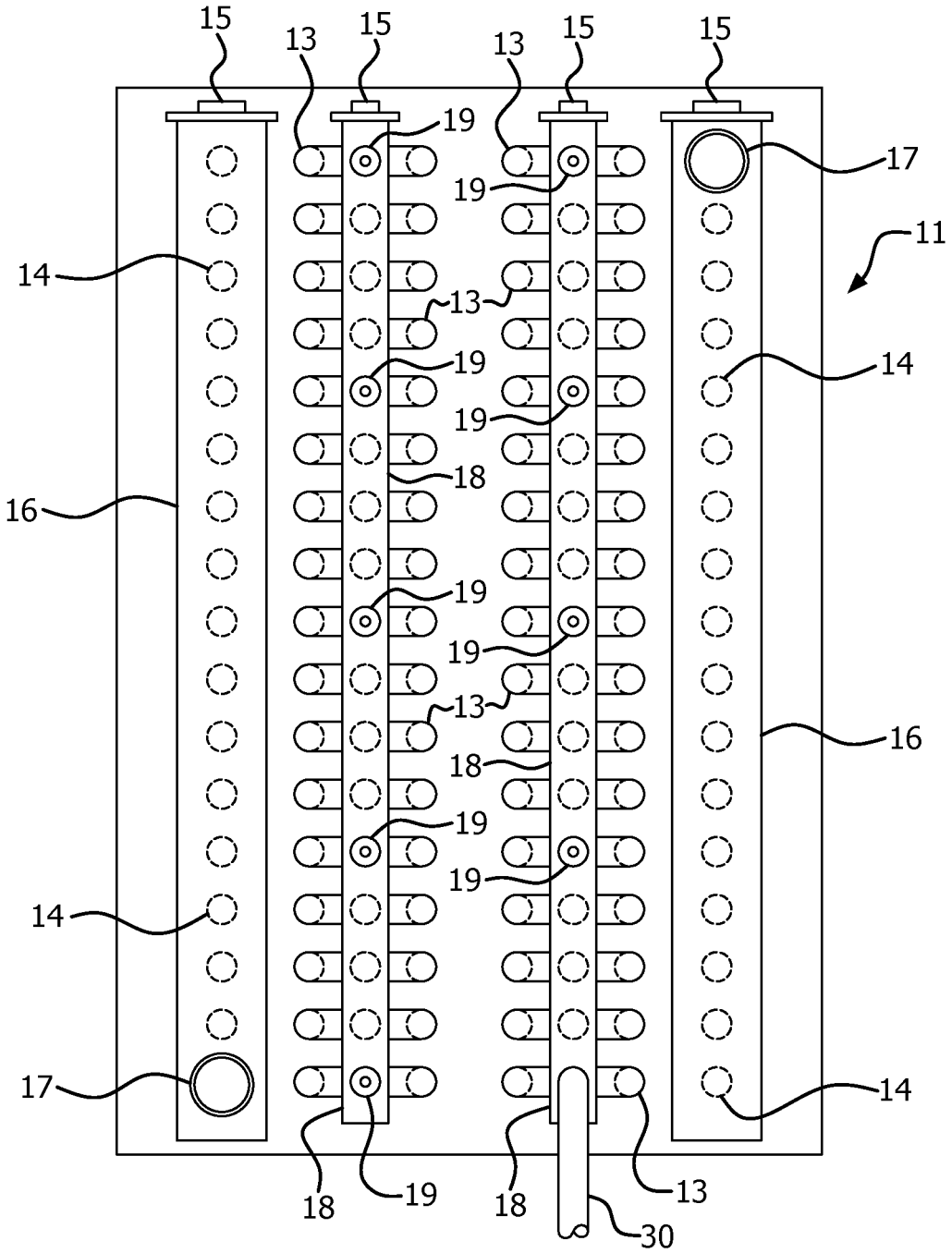
FIG. 3 is a side view of an expansion relief header in the coil assembly of FIG. 1.

FIG. 3 illustrates a side view of an example expansion relief header utilized on an HVAC tube system. The main headers 16 are mounted on each side of the system. The main header 16 on the right has the piping 17 connected to the top in order to supply the liquid while the main header 16 on the left has the piping 17 connected to the bottom in order to return the liquid. The main headers 16 include vent connections 15 for air removal and/or draining. Note, the vent connections 15 are only illustrated on the top for ease of illustration but would also be included on the bottom. The expansion relief headers 18 are connected to each of the bends 13 and may include a plurality of relief devices 19.

As shown in FIGS. 1 and 4, one or more of the expansion relief headers 18 has a pressure relief valve 30 connected to it. The pressure relief valve 30 may be instead of or in addition to the relief devices 19. If the expansion relief header 18 has both a pressure relief valve 30 and relief devices 19, then the pressure relief valve 30 is preferably set to open at a lower pressure in the expansion relief header 18 than the relief devices 19. The relief devices 19 will then not interfere with the operation of the pressure relief valve 30, but will provide an additional protection if the pressure relief valve 30 fails to operate as intended or is overwhelmed by a very rapid expansion.

The outlet of the pressure relief valve 30 leads into a descending pipe 32 that leads into a discharge housing 34. The discharge housing 34 includes a reservoir for collecting a volume of water discharged from the coils. The discharge housing 34 is preferably an enclosure so as to inhibit other liquids from entering apart from the pipe 32. The discharge housing 34 preferably has an overflow drain 35 for allowing excess water to escape once the reservoir is filled. The discharge housing 34 includes a liquid sensor 36. In the interests of simplicity, FIG. 1 shows only one expansion relief header 18 provided with a pressure relief valve 30 and descending pipe 32 but, as shown in FIG. 4, two or more expansion relief headers 18 may feed into a single discharge housing 34 through a common drain pipe 32 or through multiple drain pipes 32. If multiple drain pipe are used, liquid sensors could be placed on each one for providing information on which sets of coils are discharging water.

The liquid sensor 36 may be of any suitable type that detects the presence of liquid in the bottom of the discharge housing 34, or at a predetermined level within the discharge housing 34. In an embodiment, the liquid sensor 36 is an electrical conductivity sensor, similar to those sold by Winland Electronics, Inc. (Mankato, Minn.) under the trade mark WATERBUG®. Other liquid sensors may be used. Merely by way of example, the liquid sensor 36 may be a float valve. As illustrated in FIGS. 1 and 4, the discharge housing 34 may have a sloped bottom 40 or other shaping, so that the predetermined level is reached with only a small amount of liquid, but the discharge housing 34 has a capacity for a larger volume of additional liquid. Because the liquid is captured in the discharge housing 34, the risk of flooding and damage to parts of the building around or below the air handler can be greatly reduced compared to previously proposed systems in which liquid was discharged to the exterior (typically on the rooftop).

The liquid sensor 36 is monitored by a controller 38. When the sensor 36 detects the predetermined level of liquid in the discharge housing 34, implying that the liquid in the tubes 10 may have started to freeze, the controller 38 may take actions to reduce the risk or extent of further freezing, in order to protect the air handler 42. For example, the controller 38 may be programmed to shut down a fan 44 that draws air through the air handler 42, to close one or more shutters 46 in the air path through the air handler 42, to open a steam control valve, and/or to activate a circulating pump to supply steam or other warmth to discourage or reverse the freezing.

Instead, or in addition, the controller 38 may trigger an audible or visible warning device 48, or may send a warning message to a remote monitoring or control station. For more specific information, there could be provided multiple liquid sensors set to provide signals at different heights so that information on the amount of fluid dispensed could be provided. It is also contemplated that additional data, such as air and/or water temperature data from the air handler or the valves could be transmitted to the monitoring or control station to permit service personnel to better understand the reason for the water discharge.

The air handler 42 may also be equipped with a preheating or heating coil 52 before the main heat transfer coil, and/or a heating or reheating coil 54 after the main heat transfer coil, in the direction of air flow caused by the fan 44. The heating coils 52, 54 may be supplied with hot water or steam from a heater 56, which may be circulated by a pump 58 and/or controlled by a control valve 60. When the sensor 36 detects the predetermined level of liquid in the discharge housing 34, the controller 38 may then start the pump 58, operate the control valve 60, or otherwise cause hot water or steam to be supplied to the preheating coil 52, if present, and/or cause hot or cold water or steam to be supplied to the main heat transfer coil. The supply of flowing water or steam to the main heat transfer coil can directly prevent freezing of that coil. The supply of hot water or steam to the preheating coil 52 can protect the main heat transfer coil, by raising the temperature of the air impinging on the main coil to a temperature above, or only just below, freezing, at which the air cannot effectively freeze the water in the main coil.

The air handler 42 may be installed in or on a building 50, as part of an HVAC system for the building. The building 50 may be otherwise conventional and, in the interests of conciseness, is not shown or described in more detail.

The pressure relief valve 30 may be a combined pressure and temperature sensitive device that opens if the temperature drops below a threshold, even if the pressure does not exceed the normal opening pressure of the valve 30, or that responds to a combination of low temperature and high pressure. Alternatively, the pressure relief valve 30 may be a simple pressure-responsive valve, and the controller 38 may separately monitor the temperature, and be programmed to respond to low temperature, or to a combination of low temperature and liquid released by opening of the valve 30. Where the controller 38 monitors the temperature, it may then actuate the pressure relief valve 30 or a relief device 19 to open in response to low temperatures.

The present apparatus provides a significant advance over prior systems since it incorporates a valve which is preferably selected with material properties similar to metals used in the majority of HVAC coils. Brass or alloy may be a more preferable material to plastic as it is far more durable and can handle the pressure generated by the heavy spring design that may be required to set the desired opening pressure. Typically the valve 30 is installed on the expansion relief header 18 approximately six inches (15 cm) from the bottom of the header, which is above the drain and therefore less prone to clogging if particulate deposits accumulate at the bottom of the header during the life of the coil. In some embodiments, multiple valves may be incorporated per expansion relief header depending on the overall height of the coil. However, one valve per expansion relief header is sufficient for the majority of the installations.

The choice of the opening pressure for the pressure relief valve 30 and the predetermined volume of liquid in the discharge housing 34 at which the liquid sensor 36 is triggered allow considerable versatility in customizing the trigger conditions to a specific installation. However, one significant advantage, in at least some installations, is that if the overpressure in the tubes 10 is only just high enough to start to open the pressure relief valve 30, the slight movement of the valve may be difficult to detect by monitoring the pressure relief valve 30 directly. However, if that state persists, liquid weeping from the valve 30 will gradually accumulate in the discharge housing 34, and will in due course trigger the sensor 36.

In one preferred embodiment, the present apparatus combines two relief features: an automatically re-seating temperature and pressure relief valve, and expansion relief headers. This design does not necessarily prevent a coil from freezing, which was thought to be the only possible solution in the past. With the present apparatus, the fluid in a coil is permitted to freeze without causing any bursting. The pressure in the expansion relief header, which links the coil tubes together at the return bends, increases as the ice masses form in the tubes that are in the face of the coil/air stream. As the pressure increases, the relief valve 30, and if present also the relief device(s) 19, which is preferably a combination pressure-temperature valve, that is connected to the expansion relief header, releases a small amount of water and then re-seats itself when the pressure drops below and/or temperature rises above a predetermined value. This controlled relief protects the coils from bursting upon freezing, thus reducing related coil damage and subsequent flooding.

In one embodiment, the pressure-temperature valve is selected with a pressure relief setting (opening) of approximately 150 psi (1 MPa), which is between the normal operating pressures of a typical HVAC system (i.e., approximately 30 to 130 psi) and the typical tubing burst pressures (approximately 1,500 to 3,000 psi). This has proven to be effective in actual customer beta test sites and factory wind tunnel experiments and testing.

In the preferred embodiment, the temperature/pressure relief valve 30 or relief device 19 is selected with a temperature setting of approximately 35° F. (1.7° C.) where the valve will open to release excess cold water as an added layer of protection. The industry standard temperature for chilled water being supplied to a coil typically does not go below 40° F. (4.5° C.). Therefore, when temperatures drop below this standard, the valve further protects the coil by sensing the internal (and, if desired, can sense external) temperatures, thus allowing a small volume of water to bleed off when the internal temperature drops below 35° F. The amount of water released can be preset or the valve can reseat upon the temperature rising above 35° F.

It is to be understood that even though numerous characteristics and advantages of the present invention have been presented above, together with details of the structure and function of the invention, the disclosure is illustrative only and changes may be made in detail, especially in matters of shape, size and arrangement of parts within the principles of the invention to the full extent indicated by the broad general meaning of the terms in which the appended claims are expressed.

What is claimed is:

1. An HVAC heat transfer coil with a relief component, the coil comprising:

a plurality of liquid tubes;

a plurality of bends to connect ends of adjacent liquid tubes together to form a liquid passage therebetween;

one or more expansion relief headers, wherein each of the expansion relief headers is to connect to a plurality of aligned bends, wherein the bends include holes in alignment with holes formed in the expansion relief header to enable liquid to escape from the bends into the expansion relief header;

a pressure relief valve mounted on an external surface of at least one of the one or more expansion relief headers and spaced apart from the bends of the tubes, the pressure relief valve configured to automatically open to release liquid from the at least one expansion relief header when a pressure within the expansion relief header exceeds a predetermined value and automatically close when the pressure subsequently falls below the predetermined value;

a discharge housing for containing liquid released from the pressure relief valve;

a conduit connected to the pressure relief valve and the discharge housing for channeling liquid released from the pressure relief valve to the discharge housing; and a liquid sensor mounted within the discharge housing operative to detect liquid in the discharge housing.

2. The HVAC heat transfer coil according to claim 1, wherein the liquid sensor is operative to detect when an amount of liquid in the discharge housing exceeds a predetermined amount.

3. The HVAC heat transfer coil according to claim 1, further comprising a controller responsive to the detection of liquid by the liquid sensor to generate a warning signal.

4. The HVAC heat transfer coil according to claim 1, further comprising a temperature sensor that senses the temperature within the expansion relief header and wherein the pressure relief valve is configured to open when the temperature drops below a predetermined value.

5. The HVAC heat transfer coil according to claim 1, further comprising a controller responsive to the detection of liquid by the liquid sensor to reduce an air flow through the HVAC heat transfer coil or engage a circulation pump.

6. An air handler comprising the HVAC heat transfer coil according to claim 5, wherein the controller is operative to reduce the air flow through the coils, wherein the reduction of air flow by at least one of (i) slowing or stopping a fan, and (ii) closing an air duct to or from the transfer coils.

7. A building including at least one air handler according to claim 6.

8. An air handler comprising the HVAC heat transfer coil according to claim 5, wherein the controller is operative to cause at least one of supply of water or steam to the HVAC heat transfer coil and supply of hot water or steam to a preheating coil in an air flow towards the HVAC heat transfer coil in response to the detection of liquid by the liquid sensor.

9. A building including at least one air handler according to claim 8.

10. An expansion relief header to be utilized on an HVAC heat transfer coil, the expansion relief header comprising:

a main body to be secured to bends in fluid coils of the HVAC fluid tube system, wherein the main body includes holes in alignment with holes formed in the bends to enable fluid to pass from the bends into the expansion relief header;

a pressure relief valve mounted on an external surface of at least one of the one or more expansion relief headers and spaced apart from the bends of the tubes, the pressure relief valve configured to automatically open to release liquid from the at least one expansion relief header when a pressure within the expansion relief header exceeds a predetermined value and automatically close when the pressure subsequently falls below the predetermined value;

a discharge housing for containing liquid released from the pressure relief valve;

a conduit connected to the pressure relief valve and the discharge housing for channeling liquid released from the pressure relief valve to the discharge housing; and a liquid sensor mounted within the discharge housing operative to detect liquid in the discharge housing.

11. The expansion relief header according to claim 10, wherein the liquid sensor is operative to detect when an amount of liquid in the discharge housing exceeds a predetermined amount.

12. The expansion relief header according to claim 10, further comprising a controller responsive to the detection of liquid by the liquid sensor to generate a signal.

13. The expansion relief header according to claim 10, further comprising a temperature sensor that senses the temperature within the expansion relief header and wherein the pressure relief valve is configured to open when the temperature drops below a predetermined value.

* * * * *